US006340866B1

(12) United States Patent
Yoo

(10) Patent No.: US 6,340,866 B1
(45) Date of Patent: Jan. 22, 2002

(54) PLASMA DISPLAY PANEL AND DRIVING METHOD THEREOF

(75) Inventor: Jun Yeong Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/244,893

(22) Filed: Feb. 4, 1999

(30) Foreign Application Priority Data

Feb. 5, 1998 (KR) ..... 98-3197
Sep. 9, 1998 (KR) ..... 98-37086

(51) Int. Cl.[7] ..... G09G 3/10
(52) U.S. Cl. ..... 315/169.3; 313/484; 313/505
(58) Field of Search ..... 315/169.3, 169.4, 315/169.1, 169.2; 313/484, 505, 582, 583, 584, 585, 586, 587; 345/55, 76, 77; 349/32, 33; 445/24

(56) References Cited

U.S. PATENT DOCUMENTS 3,716,742 A * 2/1973 Nakayama et al. ..... 313/182
3,898,515 A * 8/1975 Andoh et al. ..... 315/169.1
3,931,537 A * 1/1976 Nishida et al. ..... 313/188
4,116,792 A * 9/1978 Byrum, Jr. ..... 204/192 E
4,236,096 A * 11/1980 Tiemann ..... 313/485
5,349,455 A * 9/1994 Hayashi et al. ..... 315/169.4
5,574,327 A * 11/1996 Cammack et al. ..... 313/573
5,654,727 A * 8/1997 Lepselter ..... 345/60
5,759,079 A * 6/1998 Tanamachi ..... 445/25
5,777,436 A * 7/1998 Lepselter ..... 313/582
5,938,494 A * 8/1999 Betsui et al. ..... 445/24
5,962,975 A * 10/1999 Lepselter ..... 313/586
5,963,184 A * 10/1999 Tokunaga et al. ..... 345/60
5,967,872 A * 10/1999 Betsui et al. ..... 445/24
5,990,630 A * 11/1999 Nakamura ..... 315/169.4
6,005,539 A * 12/1999 Nagakubo ..... 345/60
6,020,687 A * 2/2000 Hirakawa et al. ..... 315/169.1

FOREIGN PATENT DOCUMENTS

KR 94004437 5/1994

* cited by examiner

*Primary Examiner*—Don Wong
*Assistant Examiner*—Thuy Vinh Tran
(74) *Attorney, Agent, or Firm*—Fleshner & Kim, LLP

(57) ABSTRACT

A plasma display panel that is adapted to obtain a sufficient brightness as well as to enhance a discharging efficiency. In the panel, a plurality of discharging cells, each having an electrode to be driven by a radio frequency voltage signal, is arranged in the shape of a matrix. The discharging cells allow charged particles to swing while the radio frequency voltage signal is applied so that the charged particles in the discharging cells are not reduced. The swinging charged particles allow gaseous particles to be excited and transited continuously. In this way, the actual discharging period of the panel is almost equal to a predetermined discharging period. Also, since the discharging cell has a radio frequency discharge having physical characteristics almost equal to a positive column of a glow discharge, the energy efficiency and discharging efficiency of the panel increases with respect to prior art devices. Furthermore, an amount of vacuum ultraviolet rays created by the discharge is greater than in prior art devices. As a result, the panel obtains sufficient brightness.

19 Claims, 6 Drawing Sheets

PLASMA DISPLAY PANEL AND DRIVING METHOD THEREOF

BACKGROUND OF THE INVENTION

1. Field of the Invention

This invention relates to a display device, and more particularly to an improved plasma display pane (PDP) for displaying a picture with the aid of a discharge caused by a radio frequency voltage signal. Also, this invention is directed to an improved driving method for the PDP.

2. Description of a Related Art

A conventional PDP brightens a fluorescent material by ultraviolet rays generated upon the gaseous discharge to display a picture including a character and graphic information. Then, the picture is displayed by visible rays emitted from the fluorescent material. The ultraviolet rays are emitted from gaseous particles when electrons included in the gaseous particles are excites and then transited, and are impacted to the fluorescent material. The gaseous discharge for generating such a glow discharge will be described.

A voltage signal is applied between a cathode 4 and an anode 6 installed into a discharge tube 2 as shown in FIG. 2. Then, an electrical field is formed in a discharging space between the cathode 4 and the anode 6, and electrons move from the cathode 4 toward the anode 6 in such a manner to be accelerated by the electrical field. The accelerated electron impacts into the gaseous particles, such as neutral atoms and molecules, injected in the discharging space to cause the ionization and excitation of gases. A variety pattern of luminescence appears at the glow discharge. Among the variety pattern of the luminescence, a negative glow generated in the vicinity of the cathode 4 and a positive column caused in the long region proceeding from the middle portion of the discharging space to the anode 6 affect to a brightness characteristics. Particularly, the positive column has a discharging efficiency of about 60–70 percents for the voltage that is applied between the cathode 4 and the anode 6. The positive column appears only in the case that the cathode 4 stands apart from the anode 6 above 1 mm. In other words, the electron must be moveable the long distance of above 1 mm. However, in the conventional PDP, a distance between two electrodes for receiving a discharge voltage is set below 150 $\mu$m. Due to this, the conventional PDP must have used only the negative glow having the discharging efficiency of below 6 percents.

As PDP using such a negative glow, it is an alternative current type of PDP having plasma display cells as shown in FIGS. 2A and 2B. The plasma display cells are arranged in a matrix pattern. Referring to FIGS. 2A and 2B, the plasma display cell includes an upper substrate 10 and a lower substrate 12 installed apart from each other by compartment walls 14 in parallel. These upper and lower substrates and compartment walls 14 are formed a discharging space 26. The compartment walls 14 are formed by a material reasonable for preventing an optical interference and an electrical interference between the plasma display cells, and support the upper substrate 10. First and second sustain electrodes 16A and 16B, each called as a scan/sustain electrode and a sustain electrode, are installed on the upper substrate 10 in parallel with the compartment walls 14. On the upper substrate 10 with the first and second sustain electrodes 16A and 16B, a dielectric material layer 18 is formed to have an even surface. The dielectric material layer 18 stores up an electric charge. Also, a protective film 20 can be disposed on the first dielectric material layer 18. The protective film 20 protects the first dielectric material layer 18 from a spattering of gaseous particles to extend the lifetime of the PDP and to enhance an emitting rate or second electrons. The protective film 20 frees the discharge characteristics of a fireproof metal from a variation. As the protective film 20, it is mainly used a Magnesium Oxide (MgO) film. The upper substrate 10 with the above structure is disposed on the compartment walls 14 in such a manner that the sustain electrodes 16A and 16B are opposite to the lower substrate 12. Meanwhile, the lower substrate 12 has an address electrode 22 installed in such a manner to cross with the sustain electrodes 16A and 16B. On the lower substrate 12 with the address electrode 22, there is disposed a fluorescent material layer 24. The fluorescent material saver 24 excites and then transits by vacuum ultraviolet rays generated upon a gaseous discharge. The fluorescent material layer 24 emits visible rays having a primary color such as a red, a green or a blue color at a transition. The lower substrate 12 is positioned under the compartment walls 14 in such a manner that the address electrode 22 is opposite to the sustain electrodes 16A and 16B. These upper and lower substrates 10 and 12 and compartment walls 14 provide the discharging space 26 to be filled with discharge gases such as He, Ne, Xe and so on.

In the plasma display cell with such a structure, the sustain electrodes 16A and 16B stand apart from each other about 60–80 $\mu$m. The compartment walls 14 are formed to be below 200 $\mu$m in the height. In other words, all the distances between the electrodes 16A, 16B and 22 included in the plasma display cell is below 200 $\mu$m. Due to this, the alternative current type of the PDP can not use the positive column. Consequently, the discharging efficiency of the PDP drops off. Also, the alternative current type of the PDP causes a address discharge between any one of the sustain electrode 16A and 16B and the address electrode 22 before a display discharge (or a sustained discharge) is generated between the first and second sustain electrodes 16A and 16B, thereby displaying a desired picture.

In the next, the PDP having the above structure will be described. The address discharge is generated by any one of the sustain electrodes 16A and 16B and the address electrode 22 and then the sustain discharge is continuously caused by the sustain electrodes 16A and 16B. The vacuum ultraviolet rays generating by the sustain discharge excite and transit the fluorescent material layer 24 to emit visible rays, thereby displaying a desired picture. The visible rays are generated when the fluorescent material layer 24 is transited. In other words, the alternative current type of the PDP displays a desired picture by the sustain discharge. In order to generate the sustain discharge, a sustain pulse is applied between the sustain electrodes 16A and 16B. The sustain pulse has a frequency of about 200–300 kHz and a width of about 2–3 $\mu$m, as shown in FIG. 3. Responding to the sustain pulse, the sustain discharge causes only once at the shorter moment of the period of the sustain pulse. In other words, the greater part of the period of the sustain pulse is consumed regardless of real discharge.

For example, if the sustain pulse is applied to the first sustain electrode 16A, a charged particle moves from the second sustain electrode 16B having an opposing polarity toward the first sustain electrode 16A along a discharge path, as shown in FIG. 4. Then, the gaseous particles are excited and transited by the charged particle. As a result, the sustain discharge is generated in vicinity or the second sustain electrode 16B when a predetermined time have passed since the raising edge or the sustain pulse. Also, the charged particles from the electrode 16B opposite to the first electrode 16A are stored on the dielectric material layer 18 surrounding the surfaces of the sustain electrodes 16A and 16B. In other words, a wall charge is formed on the dielectric material layer 18 when the predetermined time have passed since the sustain discharge have been started. The wall charge offsets the voltage applied between the sustain electrodes 16A and 16B to drop down a voltage input to the discharging space, thereby reducing the sustain discharge. Consequently, the sustain discharge is generated only once during the shorter moment relative to the width of the sustain pulse.

As described above, in the PDP with the plasma display cell as shown FIGS. 2A and 2B, the positive column can not be caused because the distances of the electrodes are very shorter. Due to this, the discharging efficiency of the PDP decreases. Also, since the wall charge is formed at the sustain discharge, the discharge generates only once in a moment. For re-discharge, a predetermined period is required to eliminate the wall charge. Due to this, in the PDP with the plasma display cell, the period of the real discharge is very shorter than a period set up for the discharge, and the discharging efficiency decreases more. Consequently, the PDP with the plasma display cell as shown in FIGS. 2A and 2B can not provide with a sufficient brightness. Furthermore, the PDP requires an additional signal for eliminating the wall charge.

SUMMARY OF THE INVENTION

Accordingly, it is an object of the present invention to provide a plasma display panel that is adapted to obtain a sufficient brightness as well as to enhance a discharging efficiency, and a driving method thereof.

In order to achieve these and other objects of the invention, according to one aspect of the present invention there is provided with a plasma display panel comprising at least a pair of electrodes for applying a radio frequency voltage.

According to another aspect of the present invention, there is provided with a plasma display panel including: first electrode for applying a radio frequency voltage; second electrode for supplying a video data voltage; and a discharging space implemented with gas causing a gaseous discharge.

According to still another aspect of the present invention, there is provided with a plasma display panel driving method applying a radio frequency voltage into a discharge cell through at least a pair of electrodes to cause a display discharge.

According to still another aspect of the present invention, there is provided with a plasma display panel driving method including the steps of: applying a radio frequency voltage to a first electrode to starting simultaneously the discharge of cells; supplying a second electrode with a erasing pulse in accordance with a video data to stop selectively the discharge of the cells; and feeding a radio frequency voltage to the first electrode to maintain the discharge of the cells.

According to still another aspect of the present invention, there is provided with a plasma display panel driving method including the steps of: applying a first electrode with a driving signal corresponding too a video data to select discharge cells; and supplying a radio frequency voltage to a second electrode to generated continuously a display discharges in the discharge cell selected by the driving signal.

According to still another aspect of the present invention, there is provided with a plasma display panel driving method including steps of: applying a first electrode with a driving signal corresponding to a video data to allow charged particles to be selectively injected into discharge cells; supplying a sustain voltage to additional electrodes to preserve the charged particles; and feeding a radio frequency voltage to a second electrode to generate continuously a display discharge by the charged particles.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

A PDP according to the present invention uses a radio frequency voltage signal of several tens to several hundreds MHz to cause a display discharge, i.e., a sustain discharge. In this case, since electrons perform a vibration motion (or a swing motion), the PDP keeps a display discharge while the radio frequency voltage signal is applied. In detail, if the radio frequency voltage signal having alternatively voltage polarities is applied to any one of two electrodes opposed to each other, charged particles move toward one electrode or another electrode according to the polarity of the radio frequency voltage signal. Furthermore, the polarity of the radio frequency voltage signal is inverted before the charged particle has arrived at one electrode, the charged particle into a discharging space is moving toward the other electrode positioned at opposite direction after the charged particle goes gradually slow. The charged particle into the discharging space swings between two electrodes because the polarity of the radio Frequency voltage signal is changed before the charged particles has arrived at any to one of two electrodes. Therefore, during the supplying period of the radio frequency voltage signal, the charged particles don't eliminate and the excitation and transition of gaseous particles is continuously generated. Since the display discharge is maintained during a greater part of a set discharge period, the PDP according to the present invention enhances the discharging efficiency. Furthermore, the PDP enhances more and more the discharging efficiency as well as an energy efficiency because the radio frequency discharge has a physical characteristics equal to the positive column of the glow discharge. As a result, the PDP according to the present invention can obtain a sufficient brightness in low power.

Figure 1:
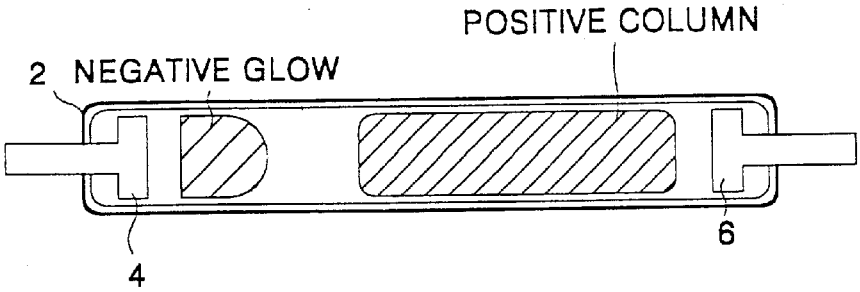
FIG.1 RELATED ART
FIG. 1 is a schematic view showing a model of a conventional gaseous discharge.
Figure 2A:
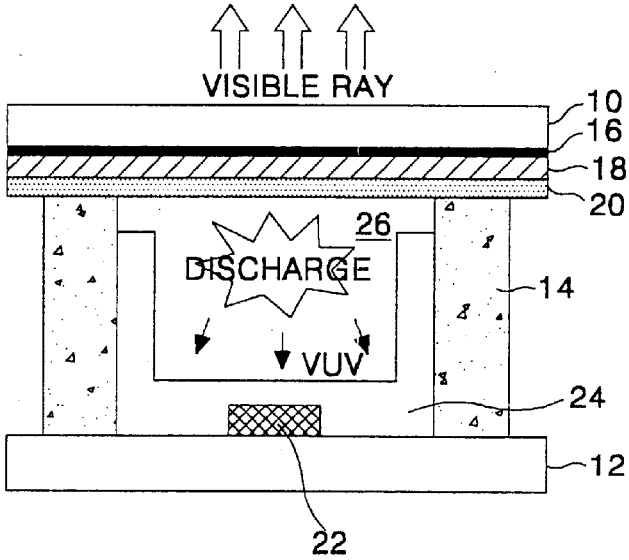
FIG.2A RELATED ART
FIGS. 2A and 2B are sectional views showing a structure of plasma display cells included in a PDP.
Figure 2B:
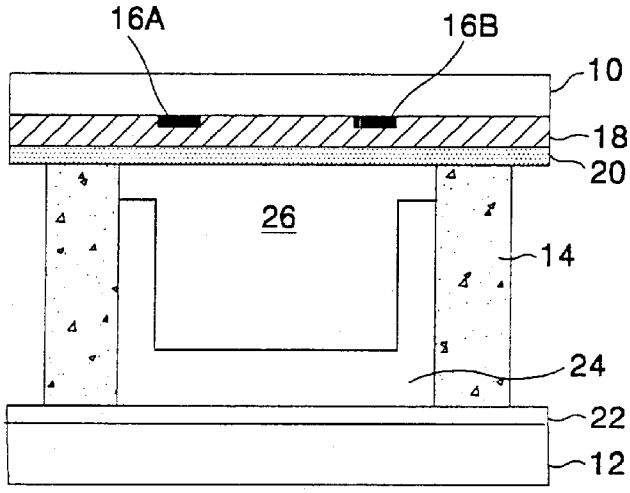
FIG.2B RELATED ART
Figure 3:
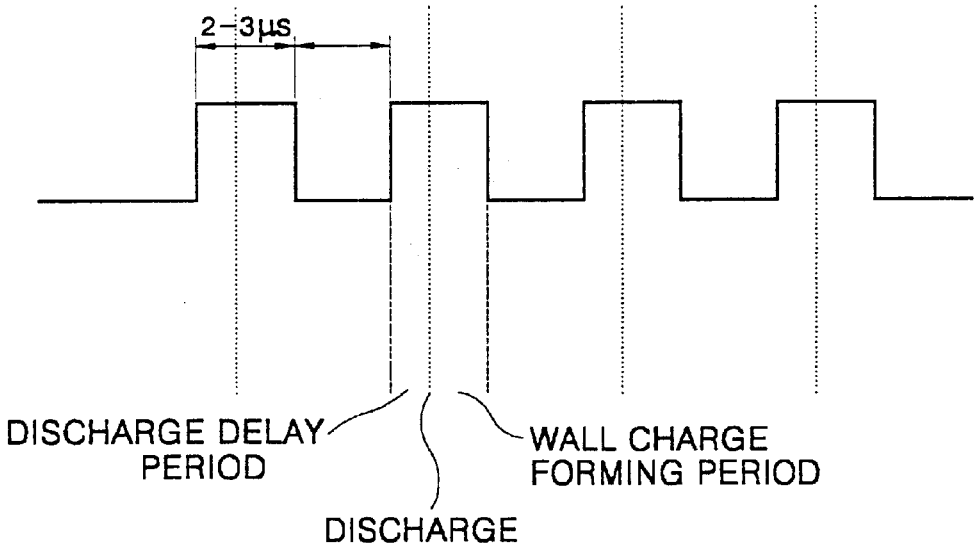
FIG. 3 RELATED ART
FIG. 3 is a waveform of a sustain pulse to be applied to a sustain electrode shown in FIGS. 2A and 2B.
Figure 4:
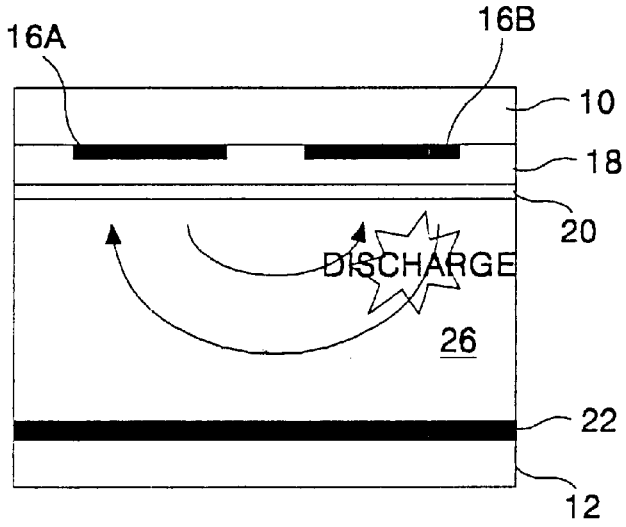
FIG. 4 RELATED ART
FIG. 4 is a schematic view of a discharge phenomenon causing in a plasma display cell shown in FIGS. 2A and 2B.
Figure 5:
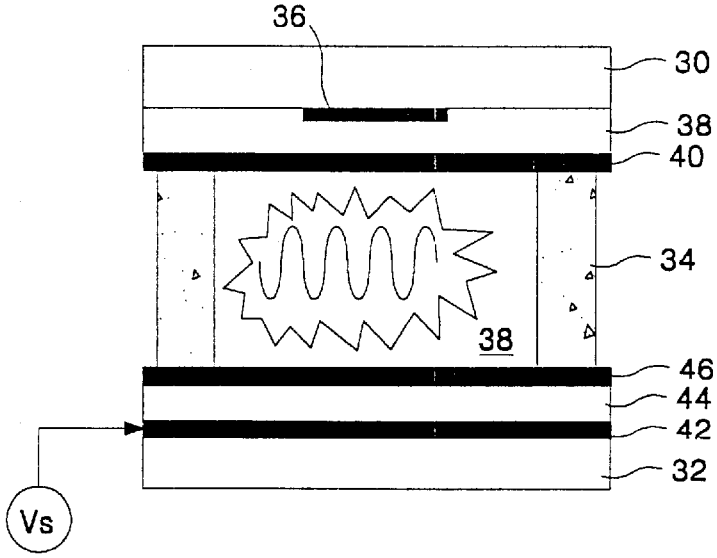
FIG. 5 is a sectional view showing a construction of a plasma display cell included in a PDP according to an embodiment of the present invention.
Figure 9:
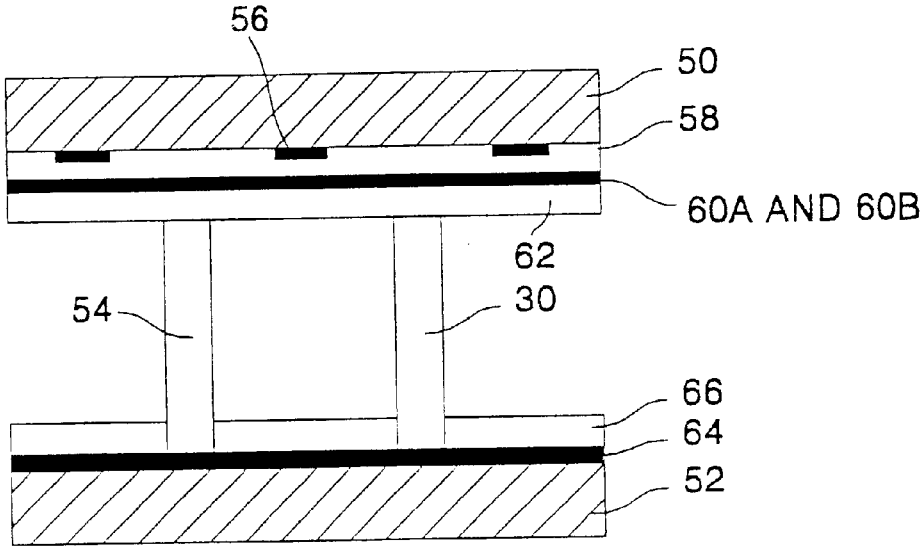
FIG. 9 is a sectional view showing a construction of a plasma display cell included In a PDP according to another embodiment of the present invention.

The PDP using the radio frequency discharge must have at least two electrodes for applying the radio frequency voltage signal to the discharging space injected with gases. Also, the PDP must include a plurality of plasma display cells each having the discharging space in order to display a picture. To this end, each the plasma display cells building the PDP can be manufactured as shown in FIG. 5. Furthermore, the PDP can further comprise a plurality of additional electrodes for selecting the plasma display cells and erasing the discharge. In this case, each the plasma display cells included in the PDP has a configuration as shown in FIG. 9.

Referring to FIG. 5, there is illustrated a plasma display cell included in a PDP according to an embodiment of the present invention. The plasma display cell includes an upper substrate 30 and a lower substrate 32 installed apart from each other by compartment walls 34 in parallel. The compartment walls 34 are formed by a material reasonable for preventing an optical interference and an electrical interference between the plasma display cells, and support the upper substrate 30. First electrode 36 is installed on the upper substrate 30 in parallel with the compartment walls 34. On the upper subs-rate 30 with the first electrode 36, first dielectric material layer 38 is formed to have an even surface. The first dielectric material layer 38 has a function of storing electric charges. Also, a protective film 40 can be disposed on the first dielectric material layer 38. The protective film 40 is not necessary because almost gaseous particles are not impacted to the first dielectric material layer 38. This result from that the gaseous particles lighten relative to the electrons are in almost stop state. However, the protective layer 40 is used to enhance an emitting rate or second electrons. The upper substrate 30 with the above structure is disposed on the compartment walls 34 in such a manner that the first electrode 36 is opposite to the lower substrate 32. Meanwhile, the lower substrate 32 has second electrode 42 installed in such a manner to cross with the first electrode 16. On the lower substrate 32 with the second electrode 42, there is sequentiality disposed a second dielectric material layer 44 and a fluorescent material layer 46. Similarly to the first dielectric Material layer 38, the second dielectric material layer 44 also stores up the electric charges. The fluorescent material layer 46 excites and then transits by vacuum ultraviolet rays generated during tile gaseous discharge. The fluorescent material layer 46 emits visible rays having a primary color such as a red, a green or a blue color, at a transition. The lower substrate 32 is positioned under the compartment walls 34 in such a manner that the second electrode 42 is opposite to the first electrode 16. These upper and lower substrates 30 and 32 and compartment walls 34 provide the discharging space 26 to be filled with discharge gases such as He, Ne, Xe and so on. Also, any one of the first and second electrodes is formed by a transparent material (for example, ITO(Indium Tin Oxide)) according to whether any one of the upper and lower substrates 30 and 32 is used as a display face. In other words, the electrode on the substrate used as the display face is formed by the transparent material.

Figure 6:
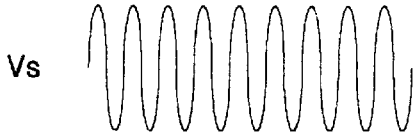
FIG. 6 is a waveform of a radio frequency voltage signal to be applied to second electrode shown in FIG. 5.

In the plasma display cell with such a structure, the discharge is started by where an alternative current voltage pulse of a low frequency as described in the related art or the radio frequency voltage signal of about 200–300 MHz as shown in FIG. 6 is supplied to the second electrode 42. The started discharge is maintained daring feeding of the radio frequency voltage signal. As a radio frequency voltage signal, a sine wave, a square wave, a sawtooth wave and so on can be used. Similarly, the plasma display cell as above described can be driven in two methods as shown in FIGS. 7 and 8.

Figure 7:
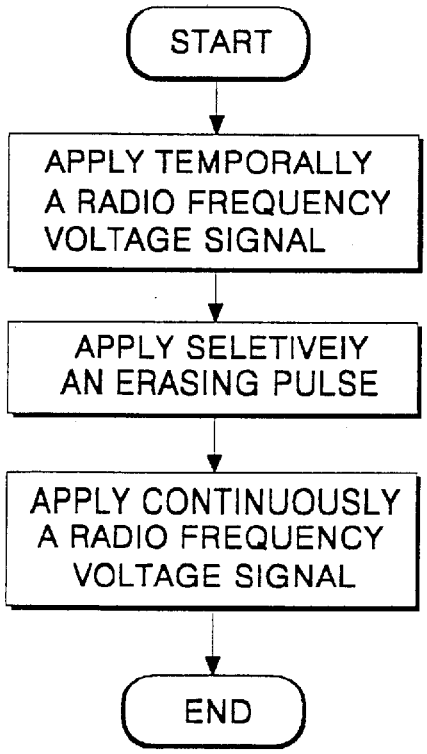
FIG. 7 is a flow chart explaining a PDP driving method according to an embodiment of the present invention.

In FIG. 7, a PDP driving method allows a radio frequency voltage signal of about 200–300 MHz to be temporally applied to the second electrode 42. A display discharge is started at all the plasma display cells on a line or on entire panel. An erasing pulse having a constant level and a specific shape is selectively supplied to the first electrodes 36 according to a video data, These Fire erased the display discharges from the plasma display cells receiving the erasing pulse. In the next, the radio frequency voltage signal is continuously applied to the second electrode 42. While the radio frequency voltage signal is applied to the second electrode 42, the display discharge is continuously generated at each the plasma display cells which the erasing pulse are not applied.

Figure 8:
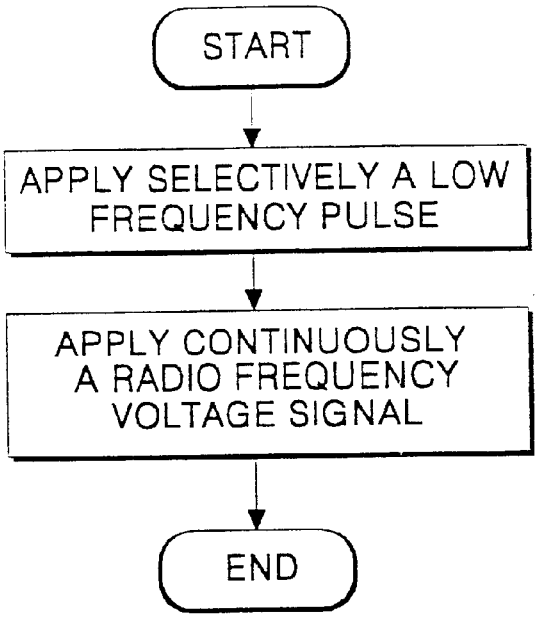
FIG. 8 is a flow chart explaining a PDP driving method according to another embodiment of the present invention.

FIG. 8 illustrates a PDP driving method according to another embodiment of the present invention. The method of FIG. 8 allows a low frequency pulse to be selectively fed to the first electrodes 36 in accordance with a video data, thereby injected selectively the charged particles into the plasma display cells on one line. Then, the display discharge is started at each the plasma display cells which the charged particles are injected. In the next, a radio frequency voltage signal is continuously applied to the second electrode 42. The plasma display cells injected with the charged particles each keep the stated display discharge while the radio frequency voltage signal is applied.

As described above, in PDP according to an embodiment of the present invention, since the radio frequency discharge is maintained while the radio frequency voltage signal is applied, a real discharging period is almost equal to the set discharge period. Also, the radio frequency discharge has a physical characteristics equal to the positive column into the glow discharge. As a result, the PDP according an embodiment of the present invention enhances a discharging efficiency and energy efficiency and is obtained a sufficient brightness.

Referring now to FIG. 9, there is shown a plasma display cell included in a PDP according to another embodiment of the present invention. The plasma display cell of FIG. 9 includes an upper substrate 50 and a lower substrate 52 installed apart from each other by compartment walls 54 in parallel. The compartment walls 54 are formed by a material reasonable for preventing an (optical interference and an electrical interference between the plasma display cells, and support the upper substrate 50. An address electrode 56 is installed on the upper substrate 50 in parallel with the compartment walls 54. On the upper substrate 50 with the address electrode 56, an insulating layer 58 is formed to have an even surface. First and second sustain electrodes 60A and 60B are also Installed on the insulating layer 58. On the insulating layer 58 with the first and second electrodes 60A and 60B, a dielectric material layer 62 is disposed to have an even surface. These address electrode 56, first and second sustain electrodes 60A and 60B are formed wish a transparent material such as an ITO (Indium Tin Oxide and so on when the upper substrate 50 is used as a display face. The dielectric material lager 62 , as a function of storing electric charges. Furthermore, a protective film can be overlaid on the dielectric material layer 62. The protective layer is used to enhance an emitting rate of second electrons. Such an upper substrate 50 with the above structure is disposed on the compartment walls 54 in such a manner that the address electrode 56 is opposite to the lower substrate 52. Meanwhile, the lower substrate 52 has a metal electrode 64 installed in such a manner to cross with the address electrode 56. The metal electrode 64 is formed with the transparent material, i.e., ITO, when the lower substrate 52 is used as a display Face. On the lower substrate 52 with the metal electrode 56, There is overlaid a fluorescent material layer 66. The fluorescent material layer 66 excites and then transits by vacuum ultraviolet rays generated during gaseous discharging. The fluorescent material layer 66 emits visible rays having a primary color such as a red, a greets or a blue color, at a transition. The lower substrate 52 is positioned under the compartment wall 54 in such a manner that the metal electrode 64 is opposite to the address electrode 56. These upper and lower substrates 50 and 52 and compartment walls 54 provide the discharging space 68 to be injected with discharge gases such as He, Ne, Xe and so on.

Figure 10:
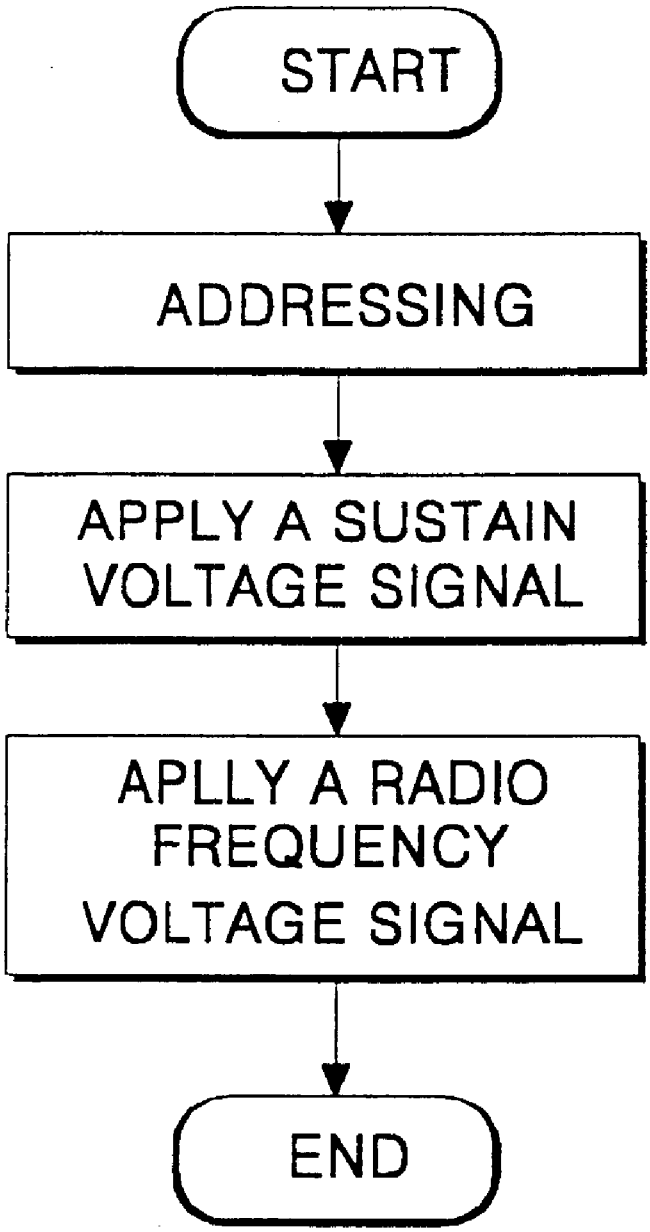
FIG. 10 is a flow chart explaining a PDP driving method according to another embodiment of the present invention.
Figure 11A:
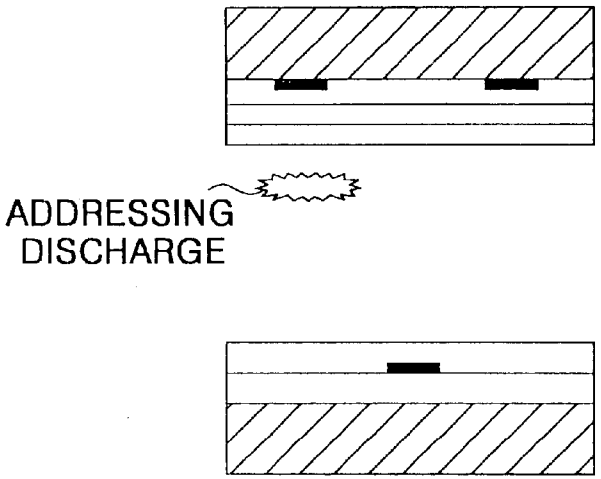
FIGS. 11A to 11C are schematic views showing discharge statuses appearing in a plasma display cell shown in FIG. 9.
Figure 11B:
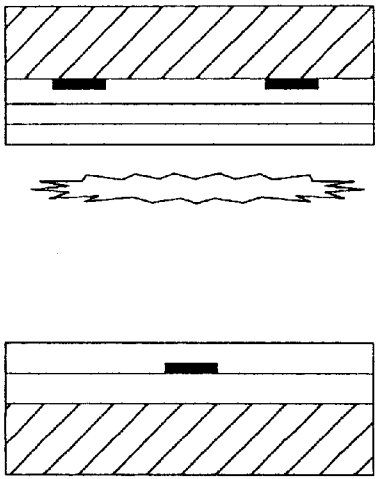

The PDP having the plasma display cell with such a structure is driven by a driving method as shown in FIG. 10. The PDP driving method of FIG. 10 applies an address signal between the address electrode 56 and any one of two sustain electrodes 60A and 602 to cause an address discharge. For example, if the address signal is applied between the address electrode 56 and the first sustain electrode 60A, the address discharge appears at the left and top portion of a discharging space 68 adjacent to the first sustain electrode 60A, as shown in FIG. 11A. Then, the charged particles are developed at the left and top potion of the discharging space 68. The address signal is sequentially applied to all lines on a panel. To this end, the plasma display cells on each line is selectively discharged responding to the address signal. As a result, the address discharge is generated only at a part of the plasma display cells on the PDP.

Also, a sustain voltage signal is supplied between the sustain electrodes 60A and 60B until the address signal has been applied to all the lines on the panel. Then, a sustain discharge is generated in vicinity of the surface of a dielectric material layer 62 positioned between the sustain n electrodes 60A and 60B. Therefore, the charged particles are originally existing at the discharging space 68.

Figure 11C:
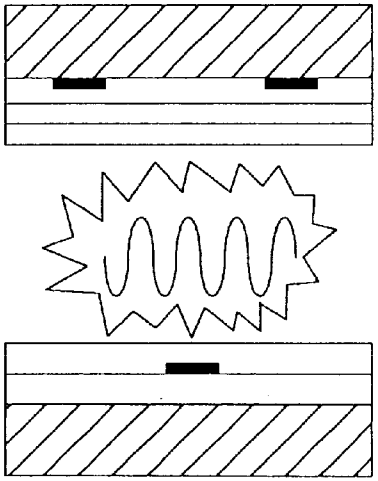

When the address signal have been applied to all the lines on the panel, a radio frequency voltage signal is supplied to the metal electrode 64. Whereas, the address electrode 56 and the sustain electrodes 60A and 60B receive a bias voltage or a ground voltage. Then, the charged particles into the discharging space 68 swing between the metal electrode 64 and the sustain electrodes 60A and 60B according to the polarity of the radio frequency voltage signal to excite and transit continuously the gaseous particles such as gaseous atoms and molecules. In other words, a radio frequency discharge is continuously generated at the center portion of the discharging space 68, as shown in FIG. 11C. Also, the fluorescent material layer 66 excites and then transits by vacuum ultraviolet rays emitted from the gaseous particles. When the fluorescent material layer 66 is transited, visible rays are emitted toward an external through the upper substrate 50. The amount of the visible rays passing through the upper substrate 50 determines brightness and/or chromaticity. Since such a radio frequency discharge is continuously generated while the radio frequency voltage is applied, the real discharging period of the PDP is almost equal to a set discharging period. Also, the radio frequency discharge has a physical characteristics equal to the positive column in the glow discharge. As a result, the PDP according to another embodiment of the present invention enhances a discharging efficiency and energy efficiency and is obtained a sufficient brightness in low power.

As described above, in the PDP and driving method thereof according to the present invention, the electrons swing into the discharging space by the radio frequency voltage signal of about several tens to several hundreds MHz higher than the prior pulse signal of several hundreds KHz. The electrons don't eliminated during applying with the radio frequency voltage signal. To this end, a display discharge is continuously generated during applying pith the radio frequency voltage signal, and furthermore the display discharge has a physical characteristics equal to the positive column in the glow discharge. As a result, the PDP according an embodiment of the present invention enhances a discharging efficiency and energy efficiency. Also, a sufficient brightness is obtained because an amount of vacuum ultraviolet rays is enlarged.

Although the present invention has been explained by the embodiments shown in the drawings described above, it should be understood to the ordinary skilled person in the art that the invention is not limited to the embodiments, but rather that various changes or modifications thereof are possible without departing from he spirit of the invention. Accordingly, the scope of the invention shall be determined only by the appended claims and their equivalents.

What is claimed is:

1. A plasma display panel having a plurality of discharging cells each including a discharging space formed by a barrier rib between first and second substrates and injected with a discharging gas and a plurality of electrode pairs disposed in the discharging space so as to cross each other, the panel comprising:

a first electrode that applies a data voltage to generate an addressing discharge; and a second electrode that applies a radio frequency voltage to generate a radio frequency discharge.

2. A plasma display panel having a plurality of discharging cells arranged in a matrix pattern, the plasma display panel comprising:

a first electrode that applies a radio frequency voltage to said plurality of discharging cells; and a second electrode for supplying a video data voltage to said plurality of discharging cells, wherein each of said discharging cells comprises a discharging space within which said first and second electrodes are disposed and wherein the discharging space is injected with gas that causes a gaseous discharge in response to the application of voltage to said first and second electrodes.

3. The plasma display panel as claimed in claim 2, wherein the discharging space includes:

a first substrate on which the first electrode is disposed and a dielectric material layer overlaid thereon including over the first electrode;

a second substrate on which the second electrode is disposed and a dielectric material layer overlaid thereon including over the second electrode; and compartment walls provided between the first and second substrates.

4. The plasma display panel as claimed in claim 3, further comprising a protective layer formed on at least one of the first and second dielectric material layers.

5. The plasma display panel as claimed in claim 3, further comprising a fluorescent material layer disposed on at least one of the compartment walls and the first and second substrates that form the discharging space.

6. The plasma display panel as claimed in claim 2, further comprising an additional electrode that selects particular discharging cells for discharge and erases the discharge.

7. The plasma display panel as claimed in claim 6, wherein the additional electrode is formed at both sides of an insulated layer.

8. The plasma display panel as claimed in claim 7, further comprising a dielectric material layer disposed on the additional electrode.

9. The plasma display panel as claimed in claim 8, further comprising a protective layer disposed on the dielectric material layer.

10. A method for driving a plasma display panel having a plurality of discharging cells each including at least a pair of electrodes, the method comprising:

applying a data voltage to generate an addressing discharge for selecting the discharging cells to be displayed; and applying a radio frequency voltage to the discharging cells to generate a display discharge depending on a radio frequency discharge, in order to display the selected discharging cells.

11. The method as claimed in clam 10, wherein the ratio frequency voltage signal is one of a sine wave, a square wave and a sawtooth wave.

12. A method of driving a plasma display panel including a plurality of discharging cells, the discharging cells each having first and second electrodes, the method comprising:

applying temporally a radio frequency voltage to a first electrode to simultaneously start the discharge of the discharging cells;

supplying a second electrode with a erasing pulse in accordance with a video data to stop selectively the discharge of the discharging cells; and feeding a radio frequency voltage to the first electrode to maintain the discharge of the discharging cells.

13. The method as claimed in claim 12, wherein the step of applying temporally a radio frequency voltage to a first electrode allows the discharge of the discharging cells to be generated by scan lines.

14. The method as claimed in claim 12, wherein the step of applying temporally a radio frequency voltage to a first electrode allows the discharge of the discharging cells to be generated at all scan lines.

15. A method of driving a plasma display panel including a plurality of discharging cells, the discharging cells each having first and second electrodes, the method comprising:

applying a first electrode with a driving signal corresponding to a video data to select discharge cells; and supplying a radio frequency voltage to a second electrode to continuously maintain a display discharge in the discharge cell selected by the driving signal.

16. The method as claimed in claim 15, wherein the driving signal is one of a direct current voltage and an alternative current voltage having a low frequency pulse.

17. A method of driving a plasma display panel including a plurality of discharging cells arranged in a matrix pattern, the discharging cells each having first and second electrodes and an additional electrode, the method comprising:

applying a first electrode with a driving signal corresponding to a video data to allow charged particles to be selectively injected into the discharge cells;

supplying a sustain voltage to additional electrodes to preserve the charged particles; and feeding a radio frequency voltage to a second electrode to continuously maintain a display discharge by the charged particles.

18. The method as claimed in claim 17, wherein the sustain signal has a low frequency pulse.

19. The method as claimed in claim 17, wherein the sustain signal has a direct current voltage.

* * * * *